US005409411A

United States Patent [19]

Schrieber

[11] Patent Number: 5,409,411

[45] Date of Patent: Apr. 25, 1995

[54] LIFE PRESERVER CHILD BED FLOTATION ASSEMBLY

[76] Inventor: Esther M. Schrieber, 377 S. Amenia Rd., Dover Plains, N.Y. 12522

[21] Appl. No.: 241,780

[22] Filed: May 12, 1994

[51] Int. Cl.[6] ..... B63C 9/00

[52] U.S. Cl. ..... 441/80; 441/88; 441/129

[58] Field of Search ..... 440/80, 88, 129–132, 440/67, 125, 128, 115; 114/345, 346, 357, 352; 5/93.1, 93.2, 94

[56] References Cited

U.S. PATENT DOCUMENTS

| | | | |
|---|---|---|---|
| 1,996,576 | 4/1935 | Hegewaldt | 9/11 |
| 2,724,843 | 11/1955 | Kimball | 441/131 |
| 3,050,753 | 8/1962 | Baker | 441/115 |
| 3,161,897 | 12/1964 | Hill | 9/347 |
| 3,471,875 | 10/1969 | Lyon | 441/130 |
| 3,740,095 | 6/1973 | Nail | 297/454 |
| 4,194,257 | 3/1980 | Martin et al. | 441/115 |
| 4,723,502 | 2/1988 | Sayama | 114/345 |
| 4,725,253 | 2/1988 | Politte | 441/130 |
| 4,811,682 | 3/1989 | Hwang et al. | 114/345 |

FOREIGN PATENT DOCUMENTS

| | | | |
|---|---|---|---|
| 0155524 | 9/1952 | Australia | 114/345 |

*Primary Examiner*—Sherman Basinger

*Attorney, Agent, or Firm*—John R. Flanagan

[57] ABSTRACT

A life preserver child bed flotation assembly includes a base having an annular framework encompassing an open central region defined through the base and an annular flotation collar attached to the framework for providing flotation capability to the base, a shell-shaped seat for reclining a child being supported on the base by the annular framework thereof and substantially over the open central region therehrough, and and a life preserver vest for releasably securing the child within the seat. The seat has front, rear and side walls connected together at their respective opposite ends and a bottom wall connected with lower edges of the front, rear and side walls. The bottom wall has forward and rearward reversely inclined portions connected together to permit the reclining of the child within the seat. The front, rear and side walls have inner and outer portions spaced apart so as to define an internal cavity therebetween being filled with a foam-like material for providing flotation capability to the seat. An annular flange extends around and is connected to the outer portions of the front, rear and side walls and is releasably connected by detent elements to sections of the annular framework of the base. The life preserver vest has a chest portion, a crotch portion and a straps attached thereto and to the walls of the seat for releasably securing the child within the seat.

17 Claims, 2 Drawing Sheets

FIG. 6
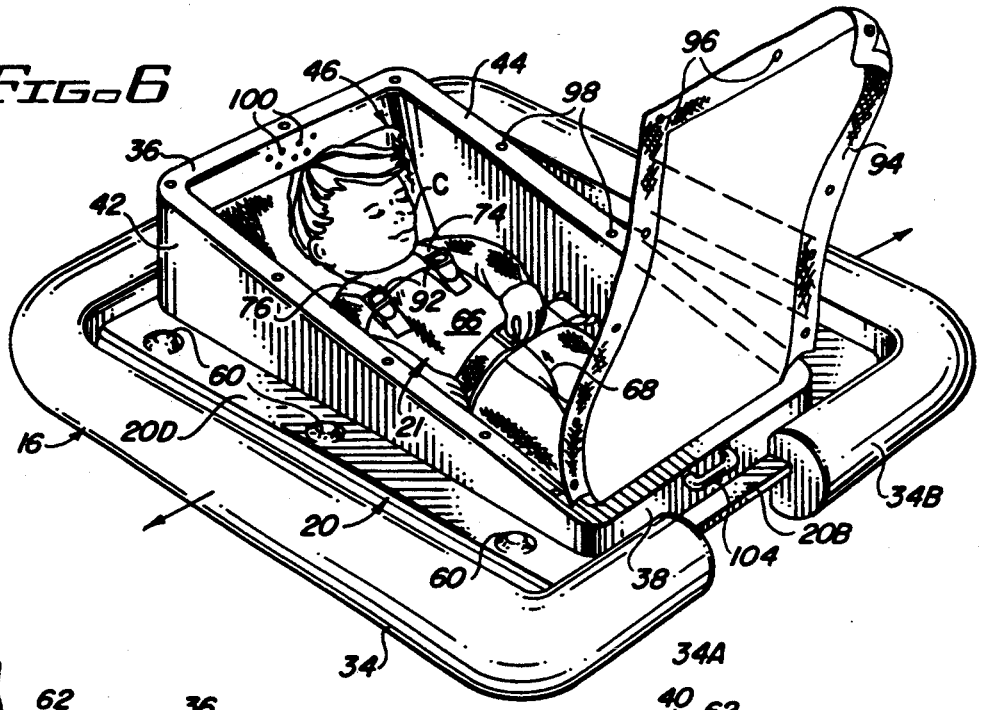
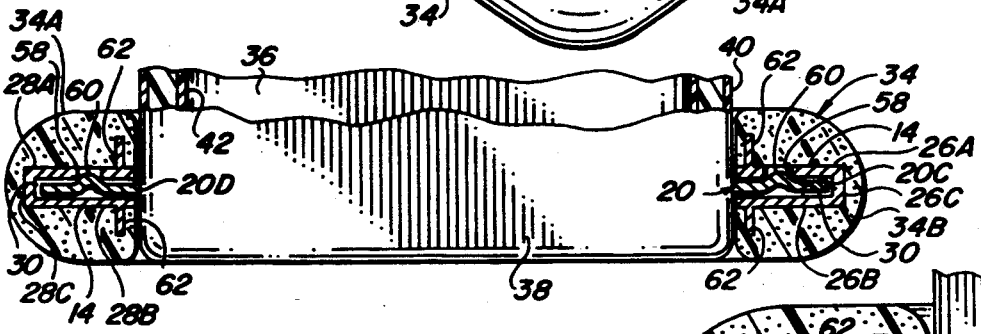
FIG. 7
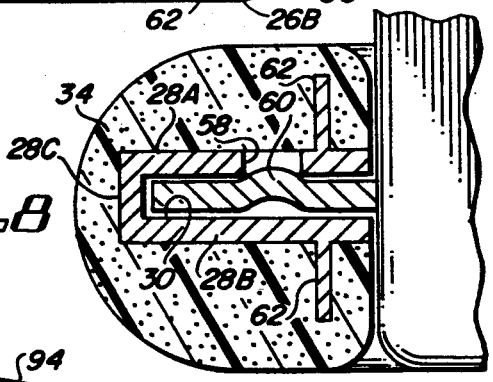
FIG. 8
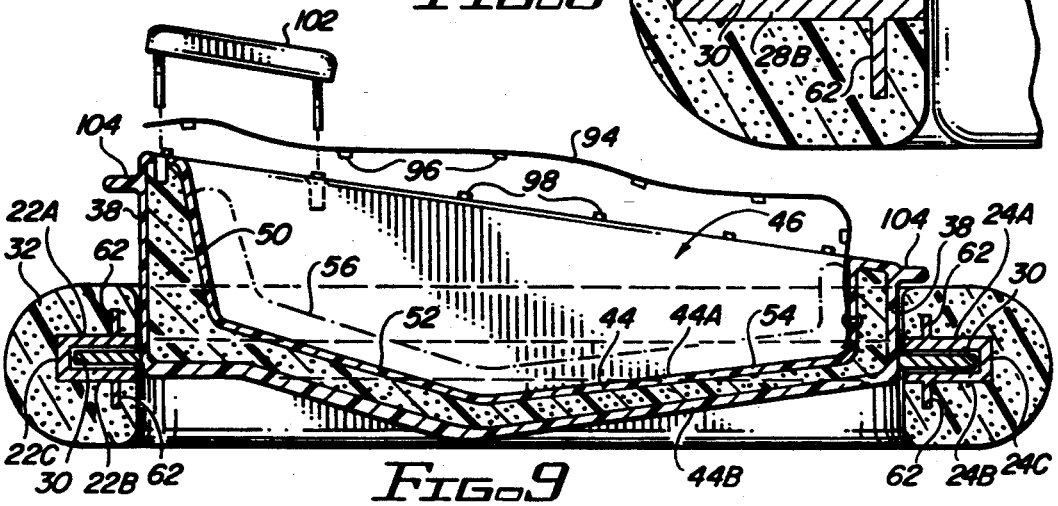
FIG. 9

LIFE PRESERVER CHILD BED FLOTATION ASSEMBLY

BACKGROUND OF THE INVENTION

1. Field of the Invention

The present invention generally relates to personal flotation devices and, more particularly, is concerned with a life preserver child bed flotation assembly.

2. Description of the Prior Art

Boating and other types of water activities are today increasingly enjoyed by family groups, whose members often include infants and young children. A variety of flotation accessories have been designed for use by children and adults in such settings. Safety considerations obviously dictate a need for life-saving flotation accessories appropriate for use with an infant or youg child should an emergency situation arise.

Some flotation accessories have been designed particularly for recreational use while other designs pertain specifically to life-saving purposes. Some representative examples of this range of accessories are disclosed in U.S. Pat. Nos. 1,996,576 to Hegewaldt, 3,161,897 to Hill, 3,740,095 to Nail, and 4,725,253 to Politte.

The flotation accessories disclosed by Hegewaldt, Hill and Nail each pertain particularly to recreational usage. The Hegewaldt and Nail accessories are designed for use by adults and older children. The Hill accessory is designed for use by a young child in water play activities and for nurturing initial swimming skills.

The accessory disclosed by Politte is focused on the life preserving function. The Politte accessory exhibits such life-saving features as body straps, rescue seeking devices and attention attracting apparatus. However, such features obviously entail substantial complexity in design and construction of the Politte accessory, thereby making manufacture fairly expensive. Additionally, reliance on the seat structure alone to provide sufficient flotation capability for the accessory in a body of water is rather problematical, given the often turbulent water conditions arising in emergency situations. Further, the Politte accessory is not particularly functional as a sleeping unit for a young child, thereby limiting its usage to strictly emergency situations.

Consequently, a need still exists for a life-preserver flotation accessory designed particularly for use with infants and young children.

SUMMARY OF THE INVENTION

The present invention provides a life preserver child bed flotation assembly (hereinafter for the sake of brevity referred to as the bed flotation assembly) designed to satisfy the aforementioned needs by avoiding the drawbacks of the prior art without introducing other drawbacks. Instead, the bed flotation assembly of the present invention provides expanded capabilities not available in the prior art.

One capability is the simplicity in design and construction of the bed flotation assembly for allowing inexpensive manufacture thereof. A second capability is the substantial area of flotation surface provided by the bed flotation assembly for sufficiently maintaining the stability and upright buoyancy thereof in turbulent waters. A third capability is the function of the bed flotation assembly as a comfortable sleeping unit for the child while traveling in a boat or other sea craft. Such adaptability of the bed flotation assembly thereby eliminates the need for transporting additional sleeping equipment for the child.

Accordingly, the present invention is directed to a life preserver child bed flotation assembly which comprises: (a) a base having an inner framework which encompasses an open central region defined through the base and an outer body attached to the inner framework and formed of a material providing flotation capability to the base; (b) a seat structure having a seat for reclining a child and a flange attached to and extending outwardly from the seat and connected to the inner framework of the base so as to support the seat structure on the base across and covering the open central region therethrough; and (c) a life preserver vest attached to the seat structure for releasably securing the child within the seat structure. The inner framework includes a pair of front and rear end frame members and a pair of opposite side frame members extending between and rigidly connected to the front and rear end frame members. The front and rear end and opposite side frame members have respective rigid hollow tubular shapes defining an annular channel being open about an inner perimeter of the annular framework. The outer body of the base is an annular collar made of rigid foam material which surrounds the upper, lower and outer sides of the front and rear end and opposite side frame members.

The seat is formed by front, rear and side walls connected together at their respective opposite ends and a bottom wall connected with lower edges of the front, rear and side walls. The bottom wall has forward and rearward reversely inclined portions connected together to permit the reclining of the child within the seat. The front, rear and side walls have inner and outer portions spaced apart so as to define an internal cavity therebetween being filled with a foam-like material for providing flotation capability to the seat. The seat flange extends around and is connected to the outer portions of the front, rear and side walls of the seat. The flange extends outwardly from the seat into the annular channel of the base defined by the annular framework and is releasably connected thereto by detent elements formed on the annular framework and seat flange.

Further, the life preserver has a chest portion, a crotch portion and a plurality of straps. The straps are secured to the walls of the seat and releasably connectable to the chest portion for releasably securing the child within the seat. The bed flotation assembly further comprises a flexible cover adapted to be converted from a folded position at one end of the seat to an extended position overlying a top of the seat for protecting the child reclining within the seat from inclement weather conditions.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 6 is a perspective view, partly exploded, of the bed flotation assembly, showing a child releasably strapped into the reclining seat and a weather cover deployed for releasable attachment over the top of the reclining seat.

FIG. 7 is an enlarged cross-sectional view of one end of the bed flotation assembly, taken along line 7—7 of FIG. 1, showing detent means for releasably attaching the reclining seat and the annular flange thereon with an inner framework of the annular base.

FIG. 8 is an enlarged detailed view of the left end of the annular base of FIG. 7, showing in detail the detent means.

FIG. 9 is a longitudinal axial sectional view of the bed flotation assembly taken along line 9—9 of FIG. 2.

DETAILED DESCRIPTION OF THE INVENTION

Figure 1:
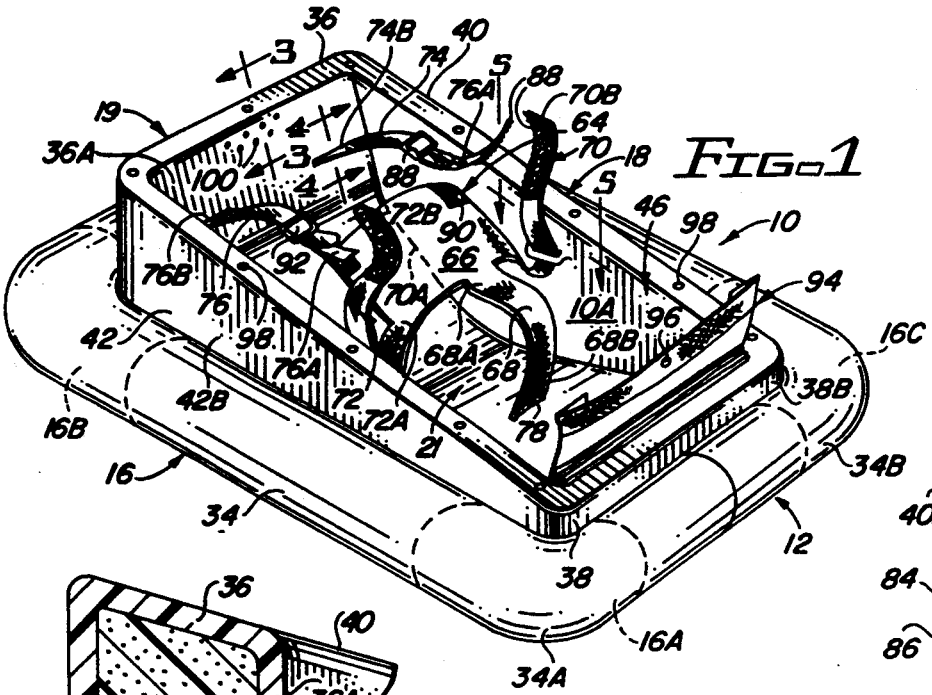
FIG. 1 is a perspective view of the life preserver child bed flotation assembly of the present invention.
Figure 4:
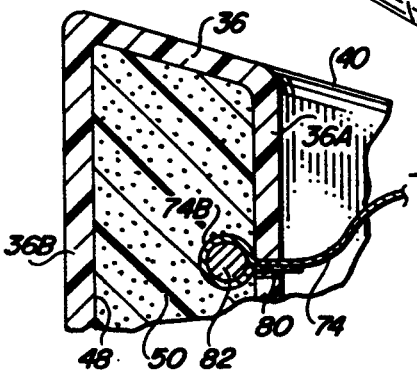
FIG. 4 is an enlarged cross-sectional view of the front end wall of the reclining seat, taken along line 4—4 of FIG. 1, showing a strap attached thereto by use of an anchor element extending longitudinally therethrough.
Figure 5:
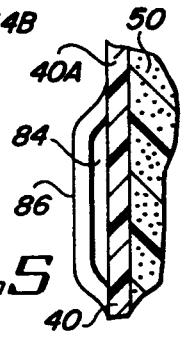
FIG. 5 is an enlarged fragmentary top sectional view of one lateral side of the reclining seat, taken along line 5—5 of FIG. 1, showing a side belt loop attached thereto.
Figure 2:
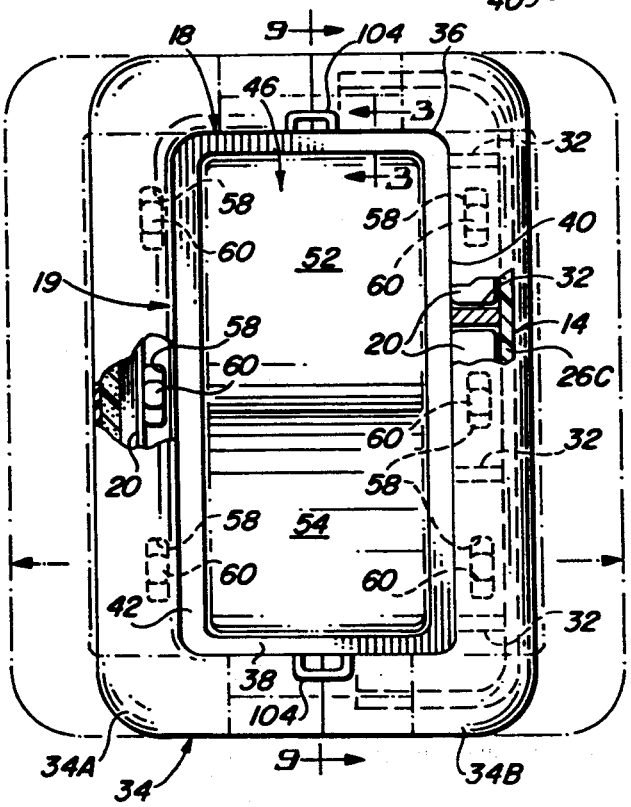
FIG. 2 is a top plan view of the bed flotation assembly, with a portion broken away, showing a flotation collar of an annular base encircling the outer perimeter of a reclining seat and without showing a life preserver means attached to the seat.

Referring to the drawings and particularly to FIGS. 1, 2, 6, 7 and 9, there is illustrated a life preserver child bed flotation assembly of the present invention, generally designated 10. Basically, the bed flotation assembly 10 includes an annular base 12 having a rigid inner framework 14 of annular configuration which encompasses an open central region defined through the base 12 and an outer body 16 being attached to the inner framework 14 and formed of a material providing flotation capability to the base 12, a seat structure 18 having a seat 19 for reclining a child C therein and an annular flange 20 attached to and extending outwardly from the seat 19 and being connected to the inner framework 14 of the annular base 12 to support the seat structure 18 thereon extending across and covering the open central region through the base 12, and life preserver means 21 attached to the seat structure 18 for releasably securing the child therein. Preferably, although not so limited, as shown in FIGS. 1, 2 and 6 the annular base 12 is formed in two C-shaped sections 12A, 12B which are mirror images of one another. The C-shaped sections 12A, 12B permit the annular base 12 to be assembled with the seat structure 18 in order to prepare the bed flotation assembly 10 for use or to be disassembled from the seat structure 18 in order to prepare the bed flotation assembly 10 for transport and storage.

More particularly as shown in FIGS. 2 and 7-9, the inner framework 14 of each C-shaped section 12A, 12B of the annular base 12 includes a pair of front and rear end frame members 22, 24 and a pair of opposite side frame members 26, 28 extending between and rigidly connected to the front and rear end frame members 22, 24 so as to provide the annular configuration of the inner framework 14. The front and rear end and opposite side frame members 22, 24, 26, 28 have respective rigid hollow rectangular tubular configurations formed by upper horizontal walls 22A, 24A, 26A, 28A lying in a first common plane, lower horizontal walls 22B, 24B, 26B, 28B lying in a second common plane extending parallel to the first common plane and an outer vertical wall 22C, 24C, 26C, 28C extending between and rigidly interconnecting the outer perimeters of the upper and lower horizontal walls so as to define a channel 30 therebetween being open about the inner perimeter of the respective sections 12A, 12B of the annular framework 12. Also, the frame members 22, 24, 26, 28 have reinforcing tabs 32 rigidly connected between the upper and lower horizontal walls 26A, 28A and 26B, 28B of the side frame members 26, 28 so as to maintain the structural integrity of the framework 12 and the desired height of the channel 30 therein. By way of example, each frame member 22, 24, 26, 28 may be made of extruded, lightweight, buoyant metal, such as aluminum.

Referring particularly to FIGS. 1, 2, 7, 8 and 10, in a preferred embodiment the outer flotation means 16 of the base 12 takes the form of an annular collar 34 of an annular configuration similar to that of the annular framework 14. The collar surrounds the upper, lower and outer walls 22A, 22B, 22C to 28A, 28B, 28C of the front and rear end and opposite side frame members 22 to 28. The flotation collar 34 is made of a buoyant, foam-like material such as polystyrene, being of sufficient strength and durability as to withstand exposure to turbulent water and weather conditions over a significant period of time. The flotation collar 34 is preferably molded in a pair of C-shaped segments 34A, 34B which together enclose the peripheral edges of the framework 14 and have an overall generally rectangular shape. The segments 34A, 34B at opposite ends can fit together, as seen in solid line form in FIGS. 1 and 2, or alternatively may be provided as a plurality of small floats 16A, 16B 16C, as seen in dashed line form in FIG. 1, wherein the floats are attached about the periphery of the framework 14 but at their opposite ends are spaced circumferentially from one another.

Referring particularly to FIGS. 1, 6 and 9, the reclining seat 19 of the bed flotation assembly 10 has a rectangular shell-like or box-like configuration and includes a pair of opposite front and rear walls 36, 38, a pair of opposite lateral side walls 40, 42 extending between and interconnecting the front and rear walls 36, 38, and a bottom wall 44 extending between and interconnecting the front and rear walls 36, 38 and opposite lateral side walls 40, 42. The reclining seat 18 is thereby closed at the bottom and defines a seat compartment 46 being open at the top. Each front, rear and lateral side wall 36–42 has spaced opposed inner and outer wall portions 36A, 36B to 42A, 42A, and the bottom wall 44 has spaced opposed inner (upper) and outer (lower) wall portions 44A, 44B, providing a double-walled construction. Preferably, the reclining seat 18 is fabricated by integrally forming the front, rear and lateral side walls 36 to 42 as a one-piece unit wherein they are interconnected along their respective adjacent perimeter edges. The inner and outer wall portions 36A, 36B to 44A, 44B of the respective front, rear, lateral side and bottom walls 56 to 64 define an internal cavity 48 within the reclining seat 19. The seat 19 is preferably made of a suitable plastic material having sufficient buoyancy and resiliency. A suitable flotation material 50 may be injected into the internal cavity 48 so as to provided additional buoyancy or flotation capability to the seat 19.

The bottom wall 44 of the seat 19 is comprised of a pair of forward and rear sections 52, 54 merging together along a central transverse bend line. The forward and rear sections 52, 54 extend angularly from one another at an angle within a range of from 120° to 150°. The angular configuration of the bottom wall 44 permits comfortable reclining of the child C thereon, as seen in FIG. 6, for sleeping purposes or for maximum safety of position in emergency use of the flotation assembly 10. For maximum comfort of the child C, a mattress pad 56, as shown in dashed outline form in FIG. 9, optimally would be positioned upon and over the inner wall portion 44A of the bottom wall 44.

Referring to FIGS. 2 and 6–9, the annular flange 20 of the seat structure 18 includes a pair of front and rear flange portions 20A, 20B and a pair of opposite side flange portions 20C, 20D attached to one another and attached to and extending in a common plane outwardly from the outer wall portions 36B, 38B, 40B, 42B of the respective front, rear and opposite lateral side walls 36, 38, 40, 42. The annular flange 20 thus extends outwardly from the seat 19 and fits into the channel 30 defined by the front, rear and side frame members 22, 24, 26, 28 of the framework 14. Suitable detent elements such as circumferentially spaced dimples 58 are formed on the annular flange 20 and such as circumferentially spaced slots 60 are defined through the upper wall portions of the annular framework 14. The dimples 58 and slots 60 are adapted to releasably interfit or snap-fit and releasably connect the annular flange 20 to the annular framework 14. The dimples 58 and slots 60 can be reversed such that the dimples 58 are formed on the annular framework 14 while the slots 60 are formed in the annular flange. The annular flange 20 on the seat 19 thereby extends into the channel 30 and is surrounded by the flotation collar 16 so as to center the seat structure 18 securely on the framework 14 of the base 12. Further, the frame members 22 to 28 have anchoring tabs 62 rigidly connected and extending outwardly from and perpendicular to the upper and lower horizontal walls 22A, 22B to 28A, 28B thereof which tabs 62 are embedded into the material of the annular flotation collar 34 so as to prevent the frame members 22 to 28 from inadvertently becoming separated from the annular flotation collar 34.

Referring to FIGS. 1 and 4–6, the life preserver means 21 of the bed flotation assembly 10 includes a vest 64 having a chest portion 66, a crotch strap 68, a pair of side straps 70, 72 attached thereto, and a pair of shoulder straps 74, 76 attached to the front wall 36 of the seat 18 for releasable attachment to the chest portion 66. The vest 64 and the plurality of straps 68–76 are made of a durable flexible inelastic waterproof fabric, such as nylon. The chest portion 66 of the vest 64 is of rectangular configuration. The plurality of straps 68–76 are narrow strips of fabric extending between a pair of opposite ends. The crotch strap 68 is attached at one end 68A to a lower edge of the chest portion 66. Each of the shoulder straps 74, 76 is releasably attached at one end 74A, 76A to the upper opposite ends of the chest portion 66 of the vest 64. The opposite ends 68B and 74B, 76B of the respective crotch strap 68 and shoulder straps 74, 76 pass through respective slits 78, 80 defined in the bottom wall 44 and front wall 36. As exemplified by the one opposite end 74B of the shoulder strap 74, the opposite ends 68B and 74B, 76B of the respective crotch strap 68 and shoulder straps 74, 76 is wrapped about an anchor element 82, such as a metal rod, larger in diameter than the width of the respective slit 78, 80 so as to prevent release of the opposite end from the respective bottom and front walls 44, 36.

Each of the side straps 70, 72 is attached at one end 70A, 72A to a respective one of a pair of opposite side edges of the chest portion 66 of the vest 64. The opposite ends 70B, 72B of the side straps 70, 72 pass through slots 84 defined by belt loops 86 attached to the inner wall portions 40A, 42A of the opposite lateral side walls 40, 42 of the seat 19. The one ends of the straps 70 to 76 are provided with patches 88 of hook or loop fastening material applied thereon. The respective upper, lower and side edges of the chest portion 66 of the vest 64 have complementary patches 90 of hook or loop fastening material applied thereon for releasable attached together with the patches 88 on the straps. Also, each of the shoulder straps 74, 76 have two sections and buckles 92 coupling them together in a manner permitting the adjustment of the lengths of the shoulder straps 74, 76 to securely tighten the vest 64 on the child C.

Referring further to FIGS. 1, 6 and 9, the bed flotation assembly 10 also includes a weather cover 94 of rectangular configuration and made of a flexible resilient waterproof material. The weather cover 94 is attached along one end to the rear wall 38 of the seat 19. The weather cover 94 is disposed with a plurality of fasteners 96, such as snaps elements, attached to the peripheral edges thereof. A plurality of complementary fasteners 98, such as snap-receiving elements, are disposed on the upper edges of the front and lateral side walls 36, 40, 42 of the seat 19. The weather cover 94 may be folded so as to rest against the rear wall 38 of the seat 19 or may be deployed so as to extend over the open top of the compartment 46 of the seat 19 for protecting the young child C against inclement weather conditions. For such deployment, the weather cover 94 is releasably fastened to the upper edges of the seat 19 by attachment together of the complementary fasteners 96, 98.

Figure 3:
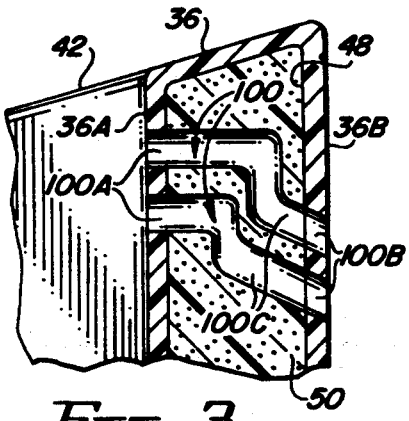
FIG. 3 is an enlarged cross-sectional view of the front end wall of the reclining seat, taken along line 3—3 of FIG. 2, showing a plurality of ventholes extending therethrough.

Also, as seen in FIGS. 1 and 3, the front wall 36 of the seat 19 has a plurality of vent passages 100 defined through an upper portion thereof. Each vent passage 100 extends through and between the opposite inner and outer portions 36A, 36B of the front wall 36 and through the material 50 filling the internal cavity 48 therebetween. Each vent passage 100 extends between a pair of inner and outer open ends 100A, 100B defined in the inner and outer portions 36A, 36B of the front wall 36. The inner open end 100A of each vent passage 100 is positioned higher than the outer open end 100B thereof and the portion 100C of the vent passage 100 extending therebetween has a zig-zag configuration so as to permit adequate air ventilation for the young child C when the weather cover 94 is in a deployed position while preventing water from passing through the vent passage 100 from the outside into the seat compartment 46.

The child C is positioned in the life preserver vest 64 by reclining the child in the seat compartment 46 of the seat 19 and with the crotch strap 68 positioned between the child's legs. The chest portion 66 of the vest 64 thereby fits over the child's chest. The side straps 70, 72 are each extended through the side belt loops 86 and releasably fastened together or to the sides of the vest 64 over the chest of the child. Each shoulder strap 74, 76 is extended from the front end wall 36 and over each shoulder of the child for releasable attachment with opposite upper edges of the chest portion 66 of the vest 64.

Referring to FIG. 9, the bed flotation assembly 10 can also include an overhead canopy 102 mountable to the tops of the front and side walls 36, 40, 42 for shading the child's head. Also, as seen in FIGS. 2, 6 and 9, the bed flotation assembly 10 can have a pair of handles 104 attached respectively on the exterior sides of the front and rear walls 36, 38 which can be used for lifting and carrying the assembly 10 and also for tethering the assembly 10 to a towing boat. Further, an appropriate bottle carrier (not shown) can be built into or attached to the interior side of one of the walls.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A life preserver child bed flotation assembly, comprising:

(a) a base having an inner framework encompassing an open central region defined through said base and an outer body attached to said inner framework and formed of a material providing flotation capability to said base, said inner framework including a pair of front and rear end frame members and a pair of opposite side frame members extending between and connected to said front and rear end frame members so as to define said framework in an annular configuration, said outer body of said base being an annular collar made of a rigid foam material surrounding and enclosing upper, lower and outer sides of said front and rear end frame members and of said opposite side frame members of said annular inner framework;

(b) a seat structure having a seat for reclining a child thereon and a flange attached to and extending outwardly from said seat and connected to said inner framework of said base so as to support said seat structure on said inner framework across and covering said open central region therethrough; and (c) a life preserver vest attached to said seat structure for releasably securing the child within said seat structure.

2. A life preserver child bed flotation assembly, comprising:

(a) a base having an inner framework encompassing an open central region defined through said base and an outer body attached to said inner framework and formed of a material providing flotation capability to said base, said inner framework including a pair of front and rear end frame members and a pair of opposite side frame members extending between and connected to said front and rear end frame members so as to define said framework in an annular configuration, said front and rear end frame members and said opposite side frame members having respective rigid hollow tubular shapes defining an annular channel being open about an inner perimeter of said annular framework;

(b) a seat structure having a seat for reclining a child thereon and a flange attached to and extending outwardly from said seat and connected to said inner framework of said base so as to support said seat structure on said inner framework across and covering said open central region therethrough; and (c) a life preserver vest attached to said seat structure for releasably securing the child within said seat structure.

3. The assembly of claim 2 wherein said outer body of said base is made of a rigid foam material.

4. The assembly of claim 2 wherein said outer body of said base is a collar surrounding said framework.

5. The assembly of claim 2 wherein said flange of said seat structure extends outwardly from said seat into said annular channel of said framework.

6. The assembly of claim 5 further comprising:

detent elements formed on said flange and said annular framework adapted to releasably connect said flange to said framework.

7. The assembly of claim 2 wherein said seat includes a pair of front and rear end walls, a pair of side walls extending between and connected to said front and rear end walls, and a bottom wall connected with lower edges of said pair of front and rear end walls and said pair of opposite side walls.

8. The assembly of claim 7 wherein said bottom wall has forward and rearward reversely inclined portions connected together to permit reclining of the child within said seat.

9. The assembly of claim 7 wherein said pair of front and rear end walls and said pair of opposite side walls have respective inner and outer portions spaced apart so as to define an internal cavity therebetween being filled with a foam-like material for providing flotation capability to said seat.

10. The assembly of claim 7 wherein said flange extends around and is connected to said outer portions of said pair of front and rear end walls and pair of opposite side walls of said seat.

11. The assembly of claim 2 wherein said life preserver vest includes a chest portion, a crotch portion attached to said chest portion and a plurality of straps secured to said seat and releasably connectable to said chest portion for releasably securing the child within said seat.

12. The assembly of claim 2 further comprising:

a flexible cover adapted to be converted from a folded position at one end of said seat to an extended position overlying a top of said seat for protecting the child reclining within said seat from inclement weather conditions.

13. A life preserver child bed flotation assembly, comprising:

(a) a base having an inner annular framework encompassing an open central region defined through said base and an outer annular collar attached to said inner annular framework and formed of a material providing flotation capability to said base;

(b) a seat structure having a seat for reclining a child thereon and a ledge attached to and extending outwardly from said seat and connected to said inner annular framework of said base so as to support said seat structure on said inner annular framework across said open central region therethrough; and (c) a life preserver vest attached to said seat structure for releasably securing the child within said seat;

(d) said inner annular framework being formed in two C-shaped sections which are mirror images of one another and permit said annular base to be assembled with said seat structure to prepare said bed flotation assembly for use and to be disassembled from said seat structure to prepare the bed flotation assembly for transport and storage.

14. The assembly of claim 13 wherein said outer annular collar of said base includes a plurality of segments.

15. The assembly of claim 13 wherein said inner framework includes a pair of front and rear end frame members and a pair of opposite side frame members extending between and connected to said front and rear end frame members so as to define said framework in an annular configuration.

16. A life preserver child bed flotation assembly, comprising:

(a) a base having an inner annular framework encompassing an open central region defined through said base and an outer annular collar attached to said inner annular framework and formed of a material providing flotation capability to said base, said inner framework including a pair of front and rear end frame members and a pair of opposite side frame members extending between and connected to said front and rear end frame members so as to define said framework in an annular configuration, said outer annular collar of said base is made of a rigid foam material surrounding and enclosing upper, lower and outer sides of said front and rear end frame members and of said opposite side frame members of said annular inner framework;

(b) a seat structure having a seat for reclining a child thereon and a ledge attached to and extending outwardly from said seat and connected to said inner annular framework of said base so as to support said seat structure on said inner annular framework across said open central region therethrough; and (c) a life preserver vest attached to said seat structure for releasably securing the child within said seat.

17. The assembly of claim 16 wherein:

said front and rear end frame members and said opposite side frame members have respective rigid hollow tubular shapes defining an annular channel being open about an inner perimeter of said annular framework;

said flange of said seat structure extending outwardly from said seat into said annular channel of said framework; and detent elements formed on said flange and said annular framework being adapted to releasably connect said flange to said framework.

* * * * *